United States Patent [19]
Bevington et al.
[11] 4,056,365
[45] Nov. 1, 1977

[54] SILVER ELECTRICAL CONTACT MATERIALS AND METHOD OF MAKING

[75] Inventors: Richard C. Bevington, Delmont; David J. Snee, Murrysville, both of Pa.

[73] Assignee: Gibson Electric, Inc., Delmont, Pa.

[21] Appl. No.: 630,349

[22] Filed: Nov. 10, 1975

[51] Int. Cl.[2] ..... B22F 3/00
[52] U.S. Cl. ..... 428/565; 75/206; 75/173 R; 75/208 R; 200/265; 200/266; 200/268; 428/548; 428/929; 75/228; 75/230
[58] Field of Search ..... 75/206, 208 R, 173 R; 29/182.5, 182.2; 200/268, 265, 266

[56] References Cited

U.S. PATENT DOCUMENTS

| | | | |
|---|---|---|---|
| 2,196,304 | 4/1940 | Hensel et al. | 75/153 |
| 2,196,306 | 4/1940 | Hensel et al. | 75/173 |
| 2,196,307 | 4/1940 | Hensel et al. | 75/173 |
| 2,213,312 | 9/1940 | Hensel | 200/166 |
| 2,425,053 | 8/1947 | Swinehart | 75/206 |
| 3,290,144 | 12/1966 | Iler et al. | 75/206 |
| 3,472,654 | 10/1966 | Comey, Jr. et al. | 200/266 |
| 3,501,287 | 3/1970 | Lever | 75/.5 |
| 3,641,298 | 2/1972 | Broverman | 29/195 |
| 3,701,654 | 10/1972 | Santala et al. | 200/266 |

*Primary Examiner*—Brooks H. Hunt
*Attorney, Agent, or Firm*—David M. Keay; Elmer J. Nealon; Norman J. O'Malley

[57] ABSTRACT

Electrical contact material of silver or mixtures of silver and a thermally decomposable compound of silver having an additive of an alkali metal, for example lithium, added in the form of a salt prior to sintering to increase the as-sintered density of the resulting material and to aid in the prevention of undesirable surface blisters. The silver material may be fabricated as a backing layer on a primary contact material of silver-cadmium oxide.

20 Claims, No Drawings

SILVER ELECTRICAL CONTACT MATERIALS AND METHOD OF MAKING

BACKGROUND OF THE INVENTION

This invention relates to electrical contact materials. More particularly, it is concerned with improving the densities of silver electrical contact materials produced by powder matallurgical methods.

Many types of electrical contacts are fabricated by powder metallurgical techniques. Contacts of certain materials, specifically silver-cadmium oxide, are extremely difficult to attach as by brazing or soldering to copper or brass backing members. In order to permit attaching of contacts of these materials to backing members it is common practice to provide backing layers of fine silver on the primary contact materials. A contact is attached to a backing member by directly soldering or brazing the silver backing layer to the backing member.

Contact materials having a backing layer of silver may be produced by the powder metallurgical technique of double fill pressing. In this technique finely-divided particles of the primary contact material, for example silver-cadmium oxide, are placed in a die cavity. A layer of silver particles is added and both powders are pressed simultaneously. The resulting bi-layer compact is then sintered to produce the final contact material.

In the preparation of silver-cadmium oxide contact materials with silver backing layers, one of the persistent problems has been that the silver layer does not shrink to the same extent as the primary contact material layer. If the shrinkage of the silver backing material and the primary contact material are not closely matched, the sintered piece is warped setting up a highly stressed region at the interface. These stresses can produce cracks, and in subsequent metal working operations, for example coining or rolling, these cracks can propagate causing ultimate failure.

There are also other undesirable effects if the silver backing layer of a contact is of insufficient density. Since the electrical conductivity is relatively low for a silver material of relatively low density, a greater amount of heat is produced by the flow of electrical current; and since the thermal conductivity is also low, heat dissipation through the backing member is low. In addition, mechanical strength and hardness are low. Flux or other impurities may become entrapped in the pores in the backing layer causing brazing problems.

Another problem with silver backing layers is surface blisters. Finely-divided silver powder has certain gases and other impurities entrapped within it. When the silver powder is heated, entrapped gases and volatile impurities evolve. If a compact of silver powder has interconnected pores, the gases and volatile impurities can escape. However, if the surface of the compact has sintered sufficiently to seal off porosity and thus prevent their escape, these gases form blisters at or near the surfaces. The problem becomes more severe with higher compacting pressures.

OBJECTS OF THE INVENTION

It is the object of the present invention to provide an improved process for preparing silver electrical contact materials.

It is also an object of the present invention to provide an improved process for preparing silver electrical contact materials having improved as-sintered densities and improved thermal and electrical properties.

It is another object of the invention to provide silver electrical contact materials having improved as-sintered densities.

It is an object of the invention to provide silver electrical contact materials having improved thermal and electrical properties.

It is also an object of the invention to provide silver electrical contact materials having blister-free surfaces.

It is another object of the invention to provide an improved process for fabricating electrical contact materials having a primary layer of silver mixed with other metals or metal compounds and a backing layer of fine silver.

It is also an object of the present invention to provide an improved process for fabricating electrical contact materials including a primary layer of silver mixed with other metals or metal compounds and a backing layer of fine silver having improved shrinkage characteristics, mechanical strength, and thermal and electrical properties.

It is a further object of the invention to provide electrical contact materials including a primary layer of silver mixed with other metals or metal compounds and a backing layer of fine silver with improve as-sintered density.

It is a still further object of the present invention to provide electrical contact material including a primary layer of silver mixed with other metals or metal compounds and a backing layer of fine silver having improved shrinkage characteristics, mechanical strength, and thermal and electrical properties.

SUMMARY OF THE INVENTION

Improved silver contact materials in accordance with the present invention are obtained by incorporating a desity-increasing additive, more specifically an additive including an alkali metal, in a compact of finely-divided particles of silver or mixtures of finely-divided particles of silver and thermally decomposable compounds of silver to be sintered. The compact is heated at a temperature below the final sintering temperature for sufficient time to decompose the additive. Then the compact is heated at the sintering temperature for sufficient time to sinter the material of the compact.

The additive is an alkali metal or an alkaline earth metal salt of an inorganic or organic acid. The additive may be incorporated in the compact as by preparing a solution of the alkaline earth metal salt in alcohol and/or water. A quantity of the solution is mixed with the particles of silver or silver and a thermally decomposable compound of silver and the mixture dried prior to pressing to form a compact. Other techniques, for example, soaking the pressed compact in a solution, may be employed to incorporate the additive into the compact. These techniques are described in greater detail in application Ser. No. 521,609 filed Nov. 7, 1974, now U.S. Pat. No. 3,969,112 issued July 13, 1976, by Han J. Kim and F. Joseph Reid entitled "Process for Preparing Silver-Cadmium Oxide Alloys."

The compact doped with the additive is heated at a temperature below the sintering temperature. The temperatures and times of heating are such as to decompose the additive. In addition, the presence of the additive prevents sintering of the silver from occurring until a higher temperature is reached. This action more readily permits evolution of entrapped gases and volatile impurities before the interconnected pores of the compact are sealed off, thereby reducing blistering of the surfaces. Further heating is carried out at appropriate temperatures for appropriate times in accordance with well-known techniques properly to sinter the materials of the compact.

In the fabrication of bi-layer electrical contact materials, for example having a primary layer of silver-cadmium oxide and a backing layer of fine silver, finely-divided particles of silver or a mixture of silver and a thermally decomposable compound of silver are mixed with an alkaline metal salt solution. The mixture is then dried and a layer is placed in a die cavity together with a layer of the primary silver-cadmium oxide particles in accordance with known double fill pressing techniques. The resulting compact is heated to decompose the alkaline metal salt and then further heated in accordance with known sintering techniques.

The resulting silver material has been found to have greater density than materials fabricated similarly but without the alkaline additive. Also blistering of the surfaces due to entrapment of gases is decreased over similarly processed materials without the additive. The alkaline metal additive found to be most useful is lithium which is added in the form of a solution of the salt of an inorganic or organic acid. Lithium nitrate in an alcohol solution is preferred although strontium nitrate and cesium nitrate have also been found suitable. The amount of alkali metal added to the silver or to the mixture of silver and decomposable compounds of silver is between .003 and 0.1 percent and preferably about 0.01 to 0.05 percent by weight of the total mixture.

Additional objects, features, and advantages of silver electrical contact materials and methods of making them in accordance with the present invention will be apparent from the following detailed discussion of specific examples.

DETAILED DESCRIPTION OF THE INVENTION

EXAMPLE I

Very finely-divided silver and silver oxide powders were combined in a mixture of 65 percent by weight silver and 35 percent by weight silver oxide. A lithium nitrate solution was prepared by dissolving 2 grams of lithium nitrate in 100 milliliters of methanol. A quantity of the solution to provide lithium in the amount of 0.015 percent by weight was added to a portion of the mixture of silver and silver oxide. The methanol was removed by vaporization. Both the portion doped with the lithium nitrate and an undoped portion were pressed using a pressure of 4 tons per square inch to produce doped and undoped compacts. The undoped compact had a density of 4.95 grams/cc and doped compacts had a density of 4.87 grams/cc. The compacts were heated to 650° C at 25° C/min and held at that temperature for 20 minutes to decompose the lithium nitrate. The compacts were then heated to 900° C at 25° C/min and held at that temperature for 1 hour. The final sintered undoped pieces had a density of 9.61 grams/cc and the doped pieces had a final sintered density of 10.31 grams/cc. The surfaces of the undoped sintered pieces exhibited slight blistering and the doped sintered pieces exhibited no surface blistering.

EXAMPLE II

Very finely-divided silver particles were mixed with a quantity of the lithium nitrate solution of Example I to provide lithium in the amount of 0.05 percent by weight of the mixture. Undoped silver powder and the doped mixture were pressed into compacts at a pressure of 4 tons per square inch. The undoped compacts had a density of 4.86 grams/cc and the doped compacts had a density of 5.11 grams/cc. These compacts were heated to 650° C at 25° C/min and held at that temperature for ½ hour. They were then heated to 900° C at 25° C/min and sintered at that temperature for 1½ hours. The final sintered density of the undoped pieces was 9.75 grams/cc and of the doped pieces was 10.09 grams/cc.

EXAMPLE III

The procedure of Example I to form compacts was repeated starting with a mixture of 50 percent by weight silver and 50 percent by weight silver oxide with the doped compacts containing 0.025 percent by weight lithium. The density of the undoped compacts was 4.54 grams/cc and of the doped compacts was 4.78 grams/cc. The compacts were heated to 650° C at 25° C/min and held at that temperature for 20 minutes. The compacts were than heated to 925° C at 25° C/min and sintered at that temperature for 1 hour. The density of the sintered undoped pieces was 9.54 grams/cc and of the doped pieces was 10.24 grams/cc. The electrical conductivity of the undoped pieces was 100 percent IACS (International Annealed Copper Standard) and of the doped pieces was 105 percent IACS.

EXAMPLE IV

Doped and undoped compacts as described in Example III were prepared. The undoped compacts had a density of 4.43 grams/cc and the doped compacts had a density of 4.55 grams/cc. The compacts were heated to 650° C at 25° C/min and held at that temperature for 40 minutes. They were then heated to 875° C at 25° C/min and sintered at that temperature for 2½ hours. The resulting undoped pieces had a density of 9.80 grams/cc and the doped pieces had a density of 10.31 grams/cc. The electrical conductivity of the undoped pieces was 98 percent IACS and of the doped pieces was 105 percent IACS.

EXAMPLE V

The lithium nitrate solution of Example I was added to a portion of a mixture of 50 percent by weight silver and 50 percent by weight silver oxide particles to provide 0.025 percent by weight lithium. The portions were pressed at 20 tons per square inch to form doped and undoped compacts. The undoped compacts had a density of 6.32 grams/cc and the doped compacts had a density of 6.33 grams/cc. The compacts were heated to 650° C at 25° C/min and held at that temperature for 20 minutes. The compacts were then heated to 925° C at 25° C/min and sintered at that temperature for 1 hour. The undoped sintered pieces had a density of 7.75 grams/cc and the surfaces exhibited moderate blistering. The doped sintered pieces had a density of 8.98 grams/cc and showed no surface blisters. The elctrical conductivity of the undoped pieces was 69.5 percent IACS and of the doped pieces was 90.5 percent IACS.

EXAMPLE VI

Doped and undoped compacts as described in Example V were prepared. The undoped compacts had a density of 6.29 grams/cc and the doped compacts had a density of 6.35 grams/cc. The compacts were heated to 650° C at 25° C/min and held at that temperature for 40 minutes. They were then heated to 875° C at 25° C/min and sintered at that temperature for 2½ hours. The resulting undoped pieces had a density of 8.48 grams/cc and exhibited moderate blistering at the surfaces. The doped pieces had a density of 9.79 grams/cc and showed no blistering. The electrical conductivity of the undoped pieces was 82 percent IACS and of the doped pieces was 100 percent IACS.

EXAMPLE VII

A portion of a mixture of very finely divided particles of 60 percent by weight silver and 40 percent by weight silver carbonate was doped with the solution of Example I to provide 0.03 percent by weight lithium. Compacts were formed by pressing undoped and doped portions at a pressure of 4 tons per square inch. The undoped compacts had a density of 4.35 grams/cc and the doped compacts had a density of 4.56 grams/cc. The compacts were heated to 650° C at 25° C/min and held at that temperature for 20 minutes. They were then heated to 925° C at 25° C/min and sintered at that temperature for 1 hour. The resulting undoped pieces had a density of 8.92 grams/cc and showed slight blistering at the surfaces. The doped pieces had a density of 10.08 grams/cc and exhibited no surface blisters. The electrical conductivity of the undoped pieces was 94.5 percent IACS and of the doped pieces was 98 percent IACS.

EXAMPLE VIII

Compacts were prepared as in Example VII. Undoped compacts had a density of 4.16 grams/cc and doped compacts had a density of 4.57 grams/cc. The compacts were heated to 650° C at 25° C/min and held at that temperature for 40 minutes. The compacts were then heated to 875° C at 25° C/min and sintered at that temperature for 2½ hours. The final sintered undoped pieces had a density of 10.03 grams/cc and were slightly blistered at the surfaces. The final sintered doped pieces had a density of 10.30 grams/cc and exhibited no blistering at the surfaces. The electrical conductivity of the undoped pieces was 99 percent IACS and of the doped pieces was 105 percent IACS.

EXAMPLE IX

Very finely-divided silver particles were mixed with the lithium nitrate solution of Example I to provide lithium as 0.05 percent by weight of the mixture. The mixture and undoped silver particles were pressed at 4 tons per square inch. The undoped compacts had a density of 4.92 grams/cc and the doped compacts had a density of 5.21 grams/cc. The compacts were heated at 650° C at 25° C/min and held at that temperature for 1 hour. They were then heated to 875° C at 25° C/min and sintered at that temperature for 2 hours. The undoped pieces had a density of 9.78 grams/cc and were slightly blistered at the surfaces. The doped pieces had a density of 10.23 grams/cc and exhibited no surface blistering. The electrical conductivity of the undoped pieces was 100 percent IACS and of the doped pieces was 104 percent IACS.

EXAMPLE X

Very finely-divided particles of fine silver and fine silver doped with the lithium nitrate solution of Example I to provide 0.05 percent lithium were pressed into compacts at a pressure of 10 tons per square inch. The undoped compacts had a density of 6.07 grams/cc and the doped compacts had a density of 6.42 grams/cc. The compacts were heated to 650° C at 25° C/min and held at that temperature for 1 hour. They were then heated to 875° C at 25° C/min and sintered at that temperature for 2 hours. The resulting undoped pieces had a density of 9.33 grams/cc and exhibited slight surface blistering. The doped pieces had a density of 9.94 grams/cc and showed no blistering. The electrical conductivity of the undoped pieces was 95 percent IACS and of the doped pieces was 100 percent IACS.

EXAMPLE XI

Very finely-divided particles of fine silver and fine silver doped with the lithium nitrate solution of Example I to provide 0.05 percent by weight lithium were formed into compacts by pressing at 4 tons per square inch. The undoped compacts had a density of 4.85 grams/cc and the doped compacts had a density of 5.27 grams/cc. The compacts were heated to 650° C at 25° C/min and held at that temperature for 20 minutes. They were then heated to 900° C at 25° C/min and sintered at that temperature for 18 hours. The resulting undoped pieces had a density of 9.14 grams/cc and were slightly blistered at the surfaces. The doped pieces had a density of 10.12 grams/cc and showed no blistering. The electrical conductivity of the undoped pieces was 88 percent IACS and of the doped pieces was 101 percent IACS.

EXAMPLE XII

Very finely-divided particles of fine silver were mixed with a solution of 1 gram of lithium carbonate in 100 milliliters of methanol to provide a mixture in which the lithium was 0.03 percent by weight. Compacts were formed of the mixture and of fine silver by pressing at 4 tons per square inch. The undoped compacts had a density of 4.85 grams/cc and the doped contacts had a density of 5.32 grams/cc. The compacts were heated to 650° C at 25° C/min and held at that temperature for 20 minutes. They were then heated to 900° C at 25° C/min and held at that temperature for 18 hours. The final sintered undoped pieces had a density of 9.14 grams/cc and the doped pieces had a density of 9.70 grams/cc. The electrical conductivity of the undoped pieces was 88 percent IACS and of the doped pieces was 95 percent IACS.

EXAMPLE XIII

A strontium nitrate solution was prepared by dissolving 0.0121 grams of strontium nitrate in 50 milliliters of a mixture of 4 parts by volume of methanol and 1 part by volume of water. Very finely-divided particles of fine silver were mixed with the solution to provide strontium in the amount of 0.01 percent by weight. The dried mixture and undoped silver were formed into compacts by pressing at 4 tons per square inch. The undoped compacts had a density of 5.28 grams/cc and the doped compacts had a density of 5.68 grams/cc. The compacts were heated to 650° C at 25° C/min and held at that temperature for 20 minutes. They were then heated to 875° C at 25° C/min and held at that temperature for 2¼ hours. The final sintered undoped pieces had a density of 8.93 grams/cc and an electrical conductivity of 89 percent IACS. The doped pieces had a density of 10.25 grams/cc and an electrical conductivity of 99.5 percent IACS. The undoped pieces had slight blistering at the surfaces and the doped pieces exhibited very slight blistering.

EXAMPLE XIV

A strontium nitrate solution was prepared by dissolving 0.0302 grams of strontium nitrate in 50 milliliters of a mixture of 4 parts by volume of methanol and 1 part by volume of water. The solution was added to very finely-divided particles of silver to provide 0.025 percent strontium by weight of the mixture. The mixture and similar undoped particles of silver were pressed into compacts at 4 tons per square inch. The undoped compacts had a density of 5.28 grams/cc and the doped compacts had a density of 5.65 grams/cc. The compacts were heated to 650° C at 25° C/min and held at that temperature for 20 minutes. They were then heated to 875° C at 25° C/min and held at that temperature for 2¼ hours. The resulting undoped pieces had a density of 8.93 grams/cc and an electrical conductivity of 89 percent IACS. The doped pieces had a density of 9.55 grams/cc and an electrical conductivity of 97.5 percent IACS. Surface blistering was slight on the undoped pieces and very slight on the doped pieces.

EXAMPLE XV

A cesium nitrate solution was prepared by dissolving 0.0073 grams of cesium nitrate in 50 milliliters of a mixture of 4 parts by volume of methanol and 1 part by volume of water. Very finely-divided silver particles were mixed with the solution to provide cesium in the amount of 0.01 percent by weight. Compacts were formed of the mixture and of fine silver by pressing at 4 tons per square inch. The undoped compacts had a density of 5.28 grams/cc and the doped compacts had a density of 5.35 grams/cc. The compacts were heated to 650° C at 25° C/min and held at that temperature for 20 minutes. The compacts were then heated to 875° C at 25° C/min and held at that temperature for 2¼ hours. The density of the undoped sintered pieces was 8.93 grams/cc and they had an electrical conductivity of 89 percent IACS. The doped pieces had a density of 9.15 grams/cc and an electrical conductivity of 93 percent IACS. Both undoped and doped pieces showed slight surface blistering.

EXAMPLE XVI

Doped and undoped bi-layer compacts were formed using a primary material of a mixture of 85 percent by weight silver and 15 percent by weight cadmium oxide particles. The lithium nitrate solution of Example I was mixed with very finely-divided particles of silver to produce a mixture containing 0.05 percent by weight lithium. A layer of the silver-cadmium oxide mixture and a layer of undoped silver particles were placed in a die cavity of approximately 2¼ inches by 1 inch in a ratio of 7 parts to 1. A layer of the silver-cadmium oxide mixture and a layer of the doped silver were placed in a die cavity of approximately 2¼ inches by 1 inch in a ratio of 7 parts to 1. The powders were pressed at 4 tons per square inch. The undoped compact had a density of 5.13 grams/cc and the doped compact had a density of 5.08 grams/cc. The compacts were heated to 650° C at 25° C/min and held at that temperature for 1 hour. They were then heated to 915° C at 25° C/min and sintered at that temperature for 1½ hours. The undoped silver backing layer had an electrical conductivity of 104 percent IACS and the doped backing layer had an electrical conductivity of 105 percent IACS. The amount of warping of the pieces was measured by measuring the height of the highest point on the convex side of the piece above the plane established by the four corners of the convex side. The amount of warping of the piece having the undoped silver backing layer was 0.139 inch and of the piece with the doped silver backing layer was 0.020 inch.

EXAMPLE XVII

Silver-cadmium oxide, undoped silver, and doped silver containing 0.05 percent by weight lithium as lithium nitrate were prepared as in Example XVI. Layers of silver-cadmium oxide and undoped silver were placed in a 2¼ inch by 1 inch die cavity in a ratio of 7 parts to 1. Layers of silver-cadmium oxide and doped silver were similarly placed in a 2¼ inch by 1 inch die cavity in a ratio of 7 parts to 1. Both the bi-layer combinations were pressed at 10 tons per square inch. The silver layer of the undoped compact had a density of 5.45 grams/cc and the doped silver layer had a density of 5.55 grams/cc. The compacts were heated to 650° C at 25° C/min and held at that temperature for 1 hour. They were then heated to 915° C at 25° C/min and sintered at that temperature for 1½ hours. The undoped silver backing layer had an electrical conductivity of 101 percent IACS and the doped silver backing layer had an electrical conductivity of 103.5 percent IACS. The amount of warping of the pieces was measured as in Example XVI. Warping of the piece with the undoped silver backing layer was 0.195 inch and of the piece with the doped silver backing layer was 0.133 inch.

EXAMPLE XVIII

Seven parts of a mixture of 85 percent silver and 15 percent cadmium oxide particles was placed in a 2¼ inch by 1 inch die cavity. One part of a mixture of 50 percent by weight silver and 50 percent by weight silver oxide particles which were very finely divided were placed on the silver-cadmium oxide particles. Similarly 7 parts of a mixture of 85 percent by weight silver and 15 percent by weight cadmium oxide were placed in a 2¼ inch by 1 inch die cavity. One part of a mixture of 50 percent by weight silver and 50 percent by weight silver oxide doped with lithium nitrate to provide 0.012 percent by weight lithium in the mixture was placed on the silver-cadmium oxide layer. Both combinations were pressed at 4 tons per square inch. The density of the compact with the undoped silver-silver oxide layer was 4.99 grams/cc and the density of the compact with the doped silver-silver oxide layer was 4.88 grams/cc. Both compacts were heated to 650° C at 25° C/min and held at that temperature for 1 hour. They were then heated to 915° C at 25° C/min and sintered at that temperature for 1½ hours. The undoped silver backing layer had an electrical conductivity of 104 percent IACS and the doped silver backing layer had an electrical conductivity of 108 percent IACS. The amount of warping of the sintered pieces was measured as in Example XVI. Warping of the piece with the undoped silver backing layer was 0.028 inch and of the piece with the doped silver backing layer was 0.021 inch.

Silver materials of the foregoing examples incorporating an alkali metal additive in accordance with the present invention exhibited increased density and therefore improved electrical and thermal characteristics. In addition, in most examples there was no blistering at the surfaces of the material. The most significant difference in density between undoped and doped materials was obtained in materials compacted at a pressure of 4 tons per square inch rather than at very high pressures of 10 or 20 tons per square inch. At the very high compacting pressures undoped materials exhibited excessive surface blistering while the doped materials showed minor or no surface blistering.

The bi-layer materials had improved shrinkage characteristics and increased mechanical strength at the interface between the layers. Warping caused by differences in shrinkage characteristics between the materials of the layers was reduced. Since the combination of silver and silver oxide shrunk upon decomposition and sintering to a greater extent than silver alone, the improvement in warping between undoped and doped bi-layer materials using silver oxide was not as pronounced as with silver alone.

The action of the alkali metal in producing silver materials of increased density is not fully understood. In the aforementioned application of Kim and Reid the use of alkali metal additives to obtain increased density of silver-cadmium alloys is disclosed. According to the theoretical teachings therein, the alkali metal compound reacts with the cadmium oxide to provide the improved results obtained from silver-cadmium oxide materials. Thus, the effects obtained by employing an alkali metal additive in the fabrication of silver materials from finely-divided particles of silver and thermally decomposable compounds of silver is unexpected.

While there has been described what are considered preferred embodiments of the present invention, it will be obvious to those skilled in the art that various changes and modifications may be made therein without departing from the invention as defined by the appended claims.

What is claimed is:

1. A method for preparing silver material comprising
forming a compact of a mixture of particles of silver or particles of silver and a thermally decomposable compound of silver together with an additive selected from the group consisting of lithium nitrate, strontium nitrate, and cesium nitrate;
heating said compact to a temperature below the final sintering temperature for a period of time sufficient to decompose said additive; and
sintering said heated compact.

2. The method of claim 1 wherein said compact contains about 0.003 to 0.1 percent by weight of lithium, strontium, or cesium.

3. The method of claim 2 wherein said additive is lithium nitrate.

4. The method of claim 2 wherein said compact is heated at about 600° to 700° C for about 20 minutes to 1 hour to decompose said additive.

5. The method of claim 2 wherein said compact is formed by
mixing particles of silver or particles of silver and a thermally decomposable compound of silver with said additive; and
pressing the material of said mixture at high pressure to form said compact.

6. The method of claim 5 wherein the material of the mixture is pressed at a pressure of the order of 4 tons per square inch.

7. A method for preparing silver material comprising
forming a compact comprising a mixture of finely-divided particles of silver or finely-divided particles of silver and a thermally decomposable compound of silver together with lithium nitrate so that lithium constitutes 0.01 to 0.05 percent by weight of the mixture;
heating said compact at about 600° to 700° C for about20 minutes to 1 hour to decompose said lithium nitrate and to drive off entrapped gases and volatile impurities; and
heating said compact at about 850° to 950° C for about $\frac{1}{2}$ to $2\frac{1}{2}$ hours to form a sintered silver compact.

8. A compact comprising a mixture of finely-divided particles of silver or finely-divided particles of silver and a thermally decomposable compound of silver and an additive selected from the group consisting of lithium, nitrate, strontium nitrate, and cesium nitrate wherein lithium, strontium, or cesium constitutes about 0.003 to 0.1 percent by weight of the mixture.

9. The compact of claim 8 wherein said additive is lithium nitrate.

10. The compact of claim 9 wherein lithium is present in the amount of about 0.01 to 0.05 percent by weight of the mixture.

11. A method for preparing contact elements comprising
forming a compact of particles of a primary contact material and a layer of a mixture of particles of silver or particles of silver and a thermally decomposable compound of silver together with an additive selected from the group consisting of lithium nitrate, strontium nitrate, and cesium nitrate;
heating said compact to a temperature below the final sintering temperature for a period of time sufficient to decompose said additive; and
sintering said heated compact to form a sintered bi-layer element of a primary contact material and a backing layer of dense silver.

12. The method of claim 11 wherein said mixture contains about 0.003 to 0.1 percent by weight of lithium, strontium, or cesium.

13. The method of claim 12 wherein said additive is lithium nitrate.

14. The method of claim 12 wherein said compact is heated at about 600° to 700° C for about 20 minutes to 1 hour to decompose said additive.

15. The method of claim 12 wherein said compact is formed by
mixing particles of silver or particle of silver and a thermally decomposable compound of silver with said additive;
forming a composite of a layer of said primary contact material and a layer of said mixture; and
pressing said composite at high pressure to form said compact.

16. The method of claim 15 wherein the composite is pressed at a pressure of the order of 4 tons per square inch.

17. A method for preparing contact elements comprising
forming a compact of particles of a primary contact material containing silver and a layer of a mixture of particles of silver or particles of silver and a thermally decomposable compound of silver together with lithium nitrate so that lithium constitutes 0.01 to 0.05 percent by weight of the mixture;

heating said compact at about 600° to 700° C for about 20 minutes to 1 hour to decompose said lithium nitrate and to drive off entrapped gases and volatile impurities; and heating said compact at about 850° to 950° C for about ½ to 2½ hours to form a sintered bi-layer contact element of a primary material containing silver and a backing layer of dense silver.

18. A bi-layer compact comprising a layer of finely-divided particles of a primary contact material containing silver; and a layer of mixture of finely-divided particles of silver or finely-divided particles of silver and a thermally decomposable compound of silver and an additive selected from the group consisting of lithium nitrate, strontium nitrate, and cesium nitrate wherein lithium, strontium, or cesium constitutes about 0.003 to 0.1 percent by weight of the mixture.

19. The compact of claim 18 wherein said additive is lithium nitrate.

20. The compact of claim 19 wherein lithium is present in the amount of about 0.01 to 0.05 percent by weight of the mixture.

* * * * *